US010708988B2

(12) United States Patent
Chang et al.

(10) Patent No.: US 10,708,988 B2
(45) Date of Patent: Jul. 7, 2020

(54) HYBRID MODULAR MICROWAVE HEATING SYSTEM WITH SEPARABLE CAVITIES

(71) Applicant: BOTTLE TOP MACHINERY CO., LTD., Nantou County (TW)

(72) Inventors: Hong-I Chang, Nantou County (TW); Kuang-Tse Chin, Nantou County (TW); Ya-Chun Yu, Nantou County (TW); Jung-Kuei Hsieh, Nantou County (TW); Chien-Hung Lin, Nantou County (TW)

(73) Assignee: BOTTLE TOP MACHINERY CO., LTD., Nantou, Nantou County (TW)

( * ) Notice: Subject to any disclaimer, the term of this patent is extended or adjusted under 35 U.S.C. 154(b) by 417 days.

(21) Appl. No.: 15/466,364

(22) Filed: Mar. 22, 2017

(65) Prior Publication Data

US 2018/0279426 A1 Sep. 27, 2018

(51) Int. Cl.
*H05B 6/80* (2006.01)
*H05B 6/64* (2006.01)

(52) U.S. Cl.
CPC ..... *H05B 6/80* (2013.01); *H05B 6/6402* (2013.01)

(58) Field of Classification Search
CPC ..... F27D 3/026; F27D 5/0068; F27D 2005/0075; H05B 6/645; H05B 6/78; H05B 6/786; H05B 6/784; H05B 6/788; H05B 6/782; H05B 6/6447; H05B 6/6402
USPC ..... 99/360, 386, 382, 381, 384, 357; 219/680, 725–735, 749, 751–754, 762
See application file for complete search history.

(56) References Cited

U.S. PATENT DOCUMENTS

| | | | | |
|---|---|---|---|---|
| 3,467,500 | A * | 9/1969 | Green | G01N 13/00 134/22.1 |
| 4,900,884 | A | 2/1990 | Aoki | |
| 4,962,298 | A | 10/1990 | Ferrari et al. | |
| 5,177,333 | A | 1/1993 | Ogasawara | |
| 5,548,101 | A | 8/1996 | Lee | |
| 5,728,310 | A * | 3/1998 | Ice | A61L 2/12 219/679 |
| 6,097,015 | A * | 8/2000 | McCullough | A61L 2/12 219/686 |
| 6,864,468 | B2 | 3/2005 | Kim et al. | |

(Continued)

*Primary Examiner* — Tu B Hoang
*Assistant Examiner* — Diallo I Duniver
(74) *Attorney, Agent, or Firm* — Muncy, Geissler, Olds & Lowe, P.C.

(57) ABSTRACT

A modular heating system includes many composite heating modules, each with a microwave resonant cavity for accommodating an object. Each is separable into two parts. One part is a microwave heating semi-cavity which includes a microwave guiding device fixed on the machine frame, and the other part is a conductive heating semi-cavity which is transferrable as a carrier of heating object. The heat-receiving object is placed into a sealed container and positioned in the microwave resonant cavity. The microwaves propagated by the microwave guiding device can heat up the object. The sealed container is configured to sustain the outward expansion pressure due to the temperature rise in the object. The microwave resonant cavities act individually and do not affect each other. They are modular so as to provide the modular heating system with the flexibility to increase or decrease the module numbers for each production line.

6 Claims, 4 Drawing Sheets

(56) References Cited

U.S. PATENT DOCUMENTS

| | | | |
|---|---|---|---|
| 7,119,313 | B2 | 10/2006 | Tang et al. |
| 2009/0230124 | A1 | 9/2009 | Senn |
| 2012/0103976 | A1 | 5/2012 | Boido |

* cited by examiner

HYBRID MODULAR MICROWAVE HEATING SYSTEM WITH SEPARABLE CAVITIES

FIELD OF THE INVENTION

The present invention relates to a system for heating objects. More particularly, it relates to a hybrid modular microwave heating system with separable cavities.

BACKGROUND OF THE INVENTION

Heating is one of the basic industrial food processes. Methods of heating includes contact heating (heating sources include fire, sheathed heaters, and ceramic heaters), microwave heating, electromagnetic induction heating and more. Contact heating is a conventional heating method. It requires a longer period of heating time since the temperature of a heat-receiving object rises from its exterior and the heat is gradually transmitted to its interior. Microwave is a kind of electromagnetic wave. Microwaves with specific frequencies enable the polar molecules of the heat-receiving object (for example, water) to resonate, so that the heating begins from the internal of the objects rapidly. When the microwaves start heating the object, however, its intensity distribution thereof will vary according to factors such as the interactions between the microwave power generator, resonant cavity, the heat-receiving object and so on, thereby leading to uneven heating in certain parts.

In order to achieve heating uniformity in microwave heating and for the purpose of continuous production, sterilization and/or pasteurization, many patents employ hot fluids (such as hot water or hot steam) as additional heating mediums (U.S. Pat. No. 7,119,313B2, U.S. Pat. No. 4,962,298). The heat-receiving object is packed inside a sealed container in advance, then sent into a microwave resonant cavity filled with high-pressure fluids. The object in the sealed container is heated by the microwaves and the fluids. As the temperature of the heat-receiving object in the sealed box rises, it would expand due to internal steam or vapor, exerting an outward pressure on the sealed container, therefore causing damage. As a result, the microwave resonant cavity must be pressurized internally so that the pressure inside the microwave resonant cavity counteracts the outward expansion pressure of the sealed container. However, at the initial stage of heating, there is no expansion pressure inside the sealed container, thus excessive pressure in the microwave resonant cavity may cause the unheated sealed container to collapse, while insufficient pressure in the microwave resonant cavity will not be able to resist the outward expansion pressure of the sealed container after it is heated, thereby causing a leakage of the sealed container. Since the maximum heating temperature is in proportion with the exerted pressure, this significantly limits the designing of the heating process. Meanwhile, such a system requires a large-scale microwave resonant cavity and the said microwave resonant cavity must be able to withstand the high pressure of the fluids. Moreover, when the sealed container is fed into and out of the microwave resonant cavity, accurate pressurization and decompression processes are necessary. For this reason, it is impossible for the sealed container to leave the microwave resonant cavity for temperature measurement and monitoring during the process. During heating, the objects are immersed in high-pressure hot water or hot steam and exposed to microwave electromagnetic field, making it difficult to track the temperature and quality of the heat-receiving objects by the usual apparatus and methods. This shows that conventional heating processes lack flexibility. Also such a system easily produces waste heat because of the hot water and hot steam used, which means unnecessary power loss.

One operation prerequisite of contact heating is that the heat-receiving object must be in tight contact with the heat source, so that the heat can be transmitted to the object efficiently. Meanwhile microwave heating requires a suitable resonant cavity to accommodate the heat-receiving object during heating. Although many patents have combined the applications of the two heating methods (U.S. Pat. Nos. 4,900,884, 6,864,468 B2, 5,548,101, 5,177,333) mentioned above, the cavities in the applications thereof are all fixed structures, wherein the heat-receiving object is merely placed in a heating plate or pan, without any means of keeping the object in tight contact with the heating source.

There are many published techniques applying microwaves to continuous heating systems (US2009/0230124 A1, US2012/0103976 A1). Such systems propagates microwaves into several heating spaces while the heat-receiving objects are continuously delivered into and out of the heating system. However, the cavities in the applications are fixed, the object is not sealed in advance and no conductive heating is introduced therein.

In summary, the existing microwave heating systems have the following technical disadvantages:

1. The cavities are fixed structures that cannot be adjusted modularly.

2. Without the use of additional heating mediums, the sealed container is not in contact with the conductive heating source, thereby leading to a lower heating efficiency.

3. When additional heating mediums are employed, the cavities need to be pressurized as well. However, the scale of this applied pressure, the heating temperature and the pressure-resisting strength of the sealed container are mutually dependent, thereby narrowing the processing condition window down to only a few choices.

4. With a conventional system, it is difficult to measure the temperature changes of the heat-receiving object during microwave heating, which means the heating program cannot implement close-loop control. As a result, such systems would not be able to satisfy the requirements of thermal processing of food.

SUMMARY OF THE INVENTION

The primary purpose of the present invention is to provide a composite microwave heating system in which each heating cavity accommodating a package of heat-receiving object is separable and modularized. The system of the present invention is operated without the need of heat-transferring fluids and counter-balancing pressure. In addition, because the cavities are modular and can be separated into two parts, the heat-receiving object can be taken out for measurement in any part of the heating process. This means any changes of quality in the heat-receiving object can be detected immediately. Therefore the heating power, and the length of the heating time, heat holding time and cooling time can be adjusted at any time of the heating process, making this heating system flexible enough to meet the needs of various heating processes.

The present invention comprises a microwave heating semi-cavity, a conductive heating semi-cavity, a conductive heating unit, a microwave heating unit and a sealed container. The conductive heating unit provides a conductive heating source, while the microwave heating unit is used to generate microwaves. The sealed container accommodates a heat-receiving object. And the microwave heating semi-cavity and the conductive heating semi-cavity can be assembled to form a microwave resonant cavity. The heat-receiving object is packed in the sealed container and then placed in the microwave resonant cavity. The microwave heating semi-cavity includes a microwave guiding device (such as a waveguide, etc.) that can deliver the microwaves radiated by the microwave heating unit into the microwave resonant cavity to heat up the object in the sealed container. The conductive heating semi-cavity has a microwave-transparent lid used to press against the sealed container inside the conductive heating semi-cavity, thereby making the sealed container in close contact with the inner wall thereof. The conductive heating semi-cavity is made of materials with good thermal conductivity and can thus receive heat from the conductive heating unit, which enables heating up the object in the sealed container by conduction heating. The hot steam, hot vapor or volume expansion due to the rise of temperature inside the object will produce an outward expansion pressure on the sealed container. The conductive heating semi-cavity lid and the conductive heating semi-cavity of the present invention are configured to have the sufficient mechanical strengths to resist the structural deformation of the sealed container in order to prevent leakage.

The system of the present invention can individually or simultaneously use microwave and traditional heating methods to heat the objects. Microwave heating can rapidly increase the temperature of the heat-receiving object in the sealed container therefore causing it to expand and press the sealed container against the conductive heating semi-cavity. As a result, it makes the contact heating of the conductive heating unit to the heat-receiving object more efficient.

As stated above, the present invention adopts means that are different from conventional techniques that apply high-pressure water, vapor, steam, etc. to resist the outward expansion pressure of the sealed container. This allows the system to be operated under atmospheric environment. Furthermore, because the pressure-resisting design of the present invention does not exert pressure on the sealed container, it therefore causes no deformation of the unheated sealed container. In summary, since the resistant strength comes from the designs of the mechanical structures, the heating temperature in the present invention can be higher than conventional heating systems could ever allow, so as to meet the needs of most thermal processes. The conductive heating semi-cavity and the microwave heating semi-cavity are assembled to form the microwave resonant cavity during microwave heating.

Then they are separated and transferred away from the microwave environment, with the conductive heating semi-cavity containing the sealed container. This way the quality (such as temperature, color, etc.) of the object in the sealed container can be measured by the usual equipment employed in conventional industrial heating processes, so that the operator will be able to monitor, record and adjust the entire heating process. With separable conductive heating semi-cavities and microwave heating semi-cavities, the present invention has the flexibility to arrange for subsequent processes of heat holding, cooling and so forth in order to meet processing needs.

DETAILED DESCRIPTION OF THE PREFERRED EMBODIMENTS

Detailed descriptions and technical contents of the present invention will be described with reference to the accompanying drawings shown below.

Figure 1:
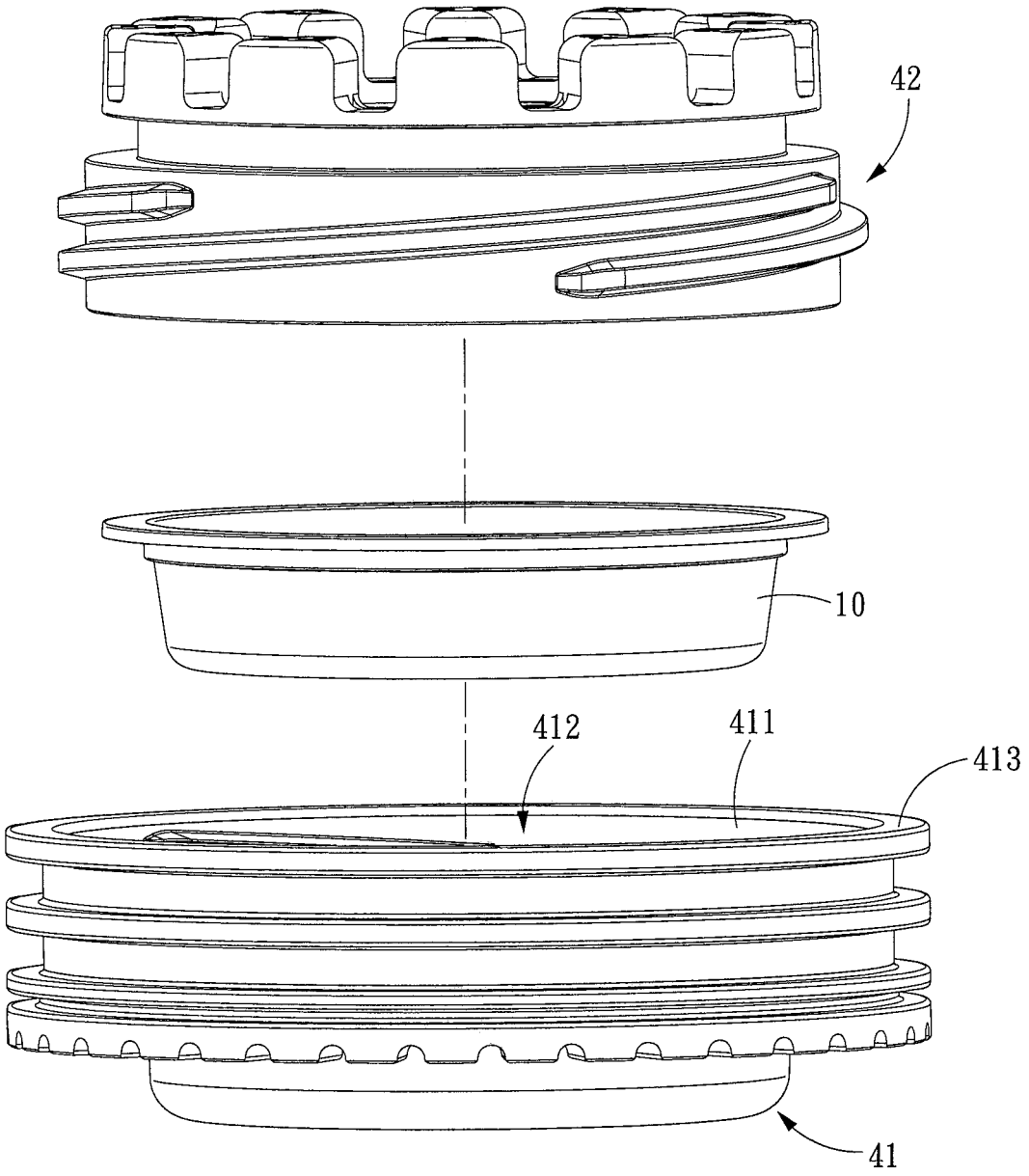
FIG. 1 is an exploded view showing the structure of a conductive heating semi-cavity of the present invention, with a sealed container placed inside.
Figure 2:
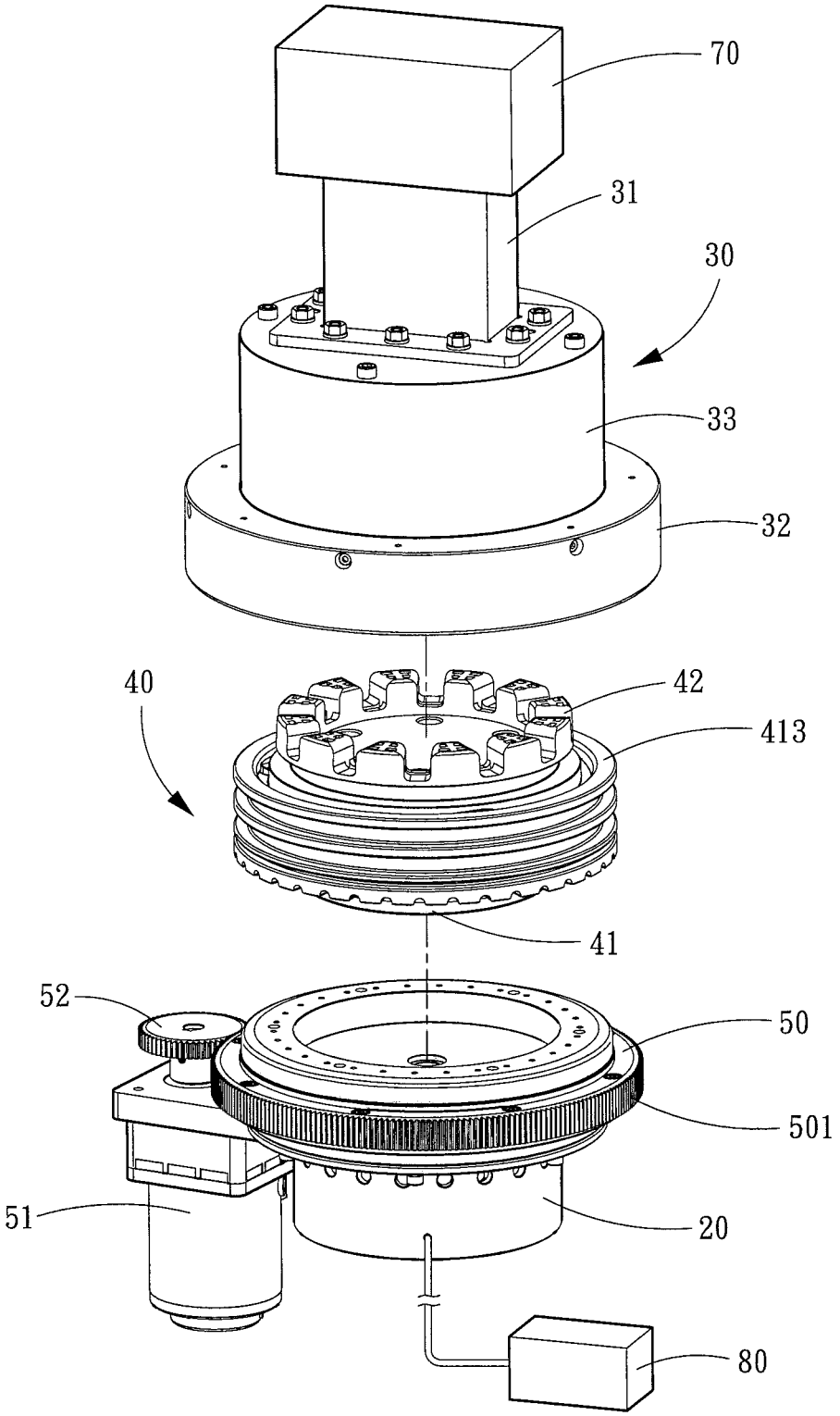
FIG. 2 is a system schematic diagram of a composite heating module comprising the conductive heating semi-cavity, the microwave heating cavity, and other components, before being assembled.
Figure 3:
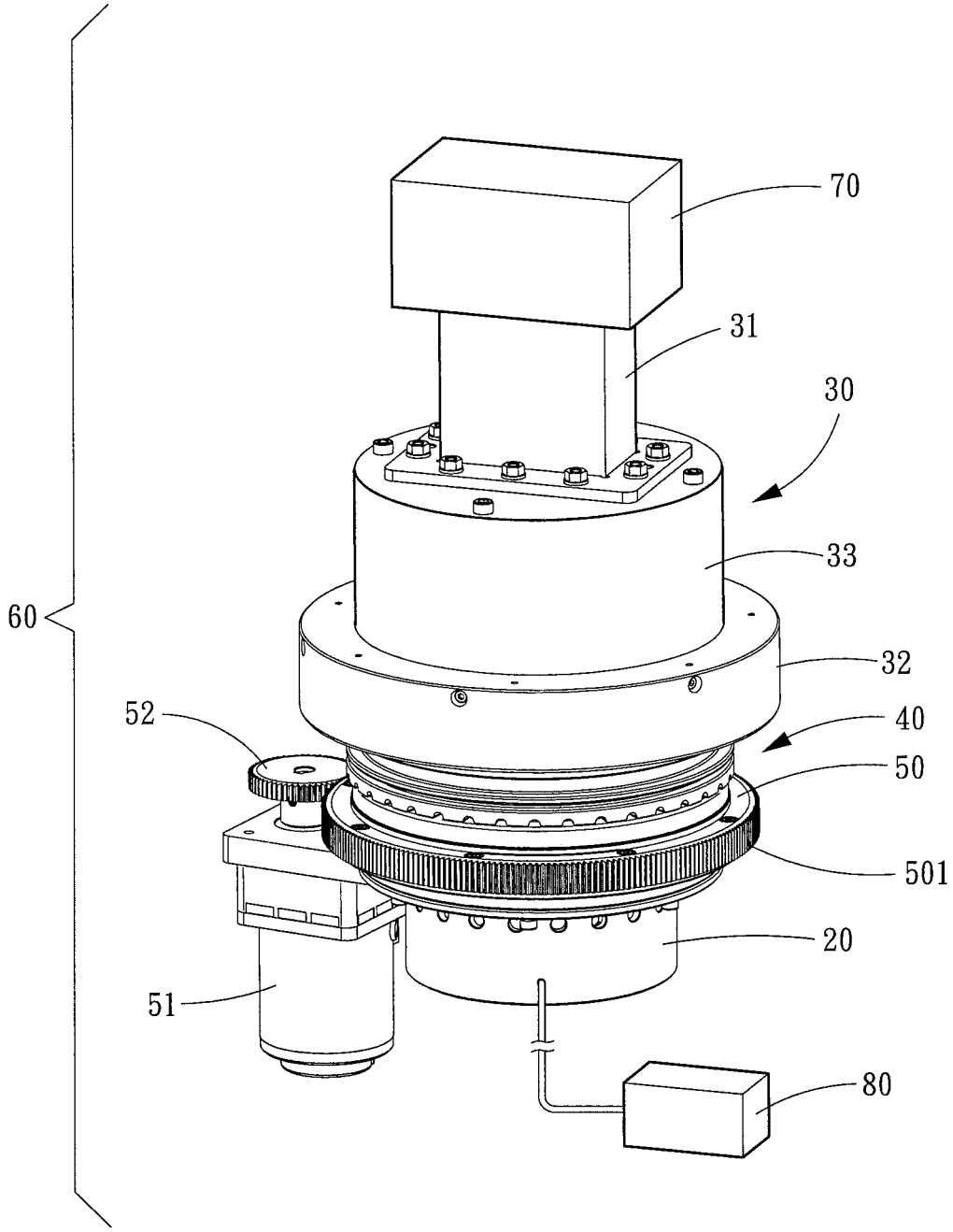
FIG. 3 is a structural appearance view of the composite heating module mentioned above after it is assembled.

Referring to FIG. 1 to FIG. 3, the present invention provides a hybrid modular microwave heating system with separable cavities used to heat objects (heat-receiving objects are not shown in the drawings). The claimed system comprises a microwave heating semi-cavity 30, a conductive heating semi-cavity 40 a conductive heating unit 20, a microwave heating unit 70 and a sealed container 10. The sealed container 10 accommodates the heat-receiving object. The conductive heating unit 20 can be an electromagnetic heater, a gas heater, an infrared lamp, a heater strip, or any other heating source that is able to transmit heat to the conductive heating semi-cavity 40. Among the options of heating sources, the most preferable is an electromagnetic induction heater which generates heat into a conductive heating semi-cavity body 41 through high-frequency electromagnetic waves. The heating power of the conductive heating unit 20 can be adjusted by a conductive heating power controller 80.

The conductive heating semi-cavity 40 comprised of the conductive heating semi-cavity body 41 as mentioned and also a conductive heating semi-cavity lid 42. The conductive heating semi-cavity body 41 includes a conductive heating semi-cavity inner wall 411, a receiving space 412 formed by the conductive heating semi-cavity inner wall 411, and a conductive heating semi-cavity outer wall 413. The conductive heating semi-cavity lid 42 is made of microwave-transparent materials. The conductive heating semi-cavity lid 42 and the conductive heating semi-cavity body 41 each possesses a fastening mean so that they can be locked together as one or opened into two.

The sealed container 10 is accommodated in the receiving space 412. When the conductive heating semi-cavity lid 42 is locked to the conductive heating semi-cavity body 41, the conductive heating semi-cavity lid 42 presses tightly against the sealed container 10. And as the object expands in volume or produces steam or vapor after being heated, the sealed container 10 will expand, pressing more tightly against the conductive heating semi-cavity inner wall 411. The expansion pressure of the sealed container 10 is sustained and counteracted by the mechanical strength of the conductive heating semi-cavity lid 42 and the conductive heating semi-cavity body 41 with no risk of leakage or damage. Thus, the heating temperature can be greatly increased.

The material of the conductive heating semi-cavity body 41 is preferably ferromagnetic and not microwave-penetrable (microwaves at such frequencies as 2.45 GHz or 915 MHz, etc.) so that when it is exposed to high-frequency electromagnetic waves (at frequencies such as 10 KHz-200 KHz), eddy current can be induced to generate heat. The conductive heating semi-cavity 40 is placed on top of the conductive heating unit 20 to receive heat from the heating source, to heat the conductive heating semi-cavity body 41.

The microwave heating semi-cavity 30 includes a wave guiding channel 31, a microwave heating semi-cavity sleeve 32 and a microwave heating semi-cavity body 33. When a composite heating module 60 is assembled, the microwave heating semi-cavity sleeve 32 presses down against the conductive heating semi-cavity outer wall 413 as illustrated in FIG. 3. After being assembled, the interior of the microwave heating semi-cavity body 33 and the receiving space 412 inside the conductive heating semi-cavity 40 will form an integrated microwave resonant cavity. In this way, the sealed container 10, with the heat-receiving object, and the conductive heating semi-cavity lid 42 are accommodated inside the microwave resonant cavity. Since the conductive heating semi-cavity lid 42 and the sealed container 10 are both made of microwave-transparent materials, the heat-receiving object placed inside the sealed container 10 thus becomes the only receiver of microwaves in the microwave resonant cavity. In addition, to effectively avoid microwave leakages, the conventional microwave leak-proof devices or structures, such as choke isolation metal rings or microwave damping structures, can be further arranged in the interfaces of the microwave heating semi-cavity sleeve 32 and the conductive heating semi-cavity outer wall 413.

The microwave heating unit 70 generates microwaves as a microwave heating source. The microwaves are propagated into the microwave resonant cavity via the wave guiding channel 31. In a preferred embodiment, the microwave heating unit 70 is further equipped with a microwave intensity adjusting function. This allows the operator to adjust the intensity of the microwave heating power, and control the length of the heating time during the process.

In order to enhance the uniformity of the heating process, the present invention further comprises a spinning plate 50 that rotates, on which the conductive heating semi-cavity 40 is loaded, and a motor 51. The spinning plate 50 is equipped with a driven gear 501, preferably an outer ring gear as shown in FIG. 2 and FIG. 3, while the motor 51 is equipped with a gear 52. The power of the motor 51 is transmitted via the gear 52 in contact with the driven gear 501 to rotate the spinning plate 50. Rotation of the conductive heating semi-cavity 40 on the spinning plate 50, as well as the sealed container 10 inside the conductive heating semi-cavity 40 improves heating uniformity. As a result, problems of uneven heating in the past are reduced significantly.

Figure 4:
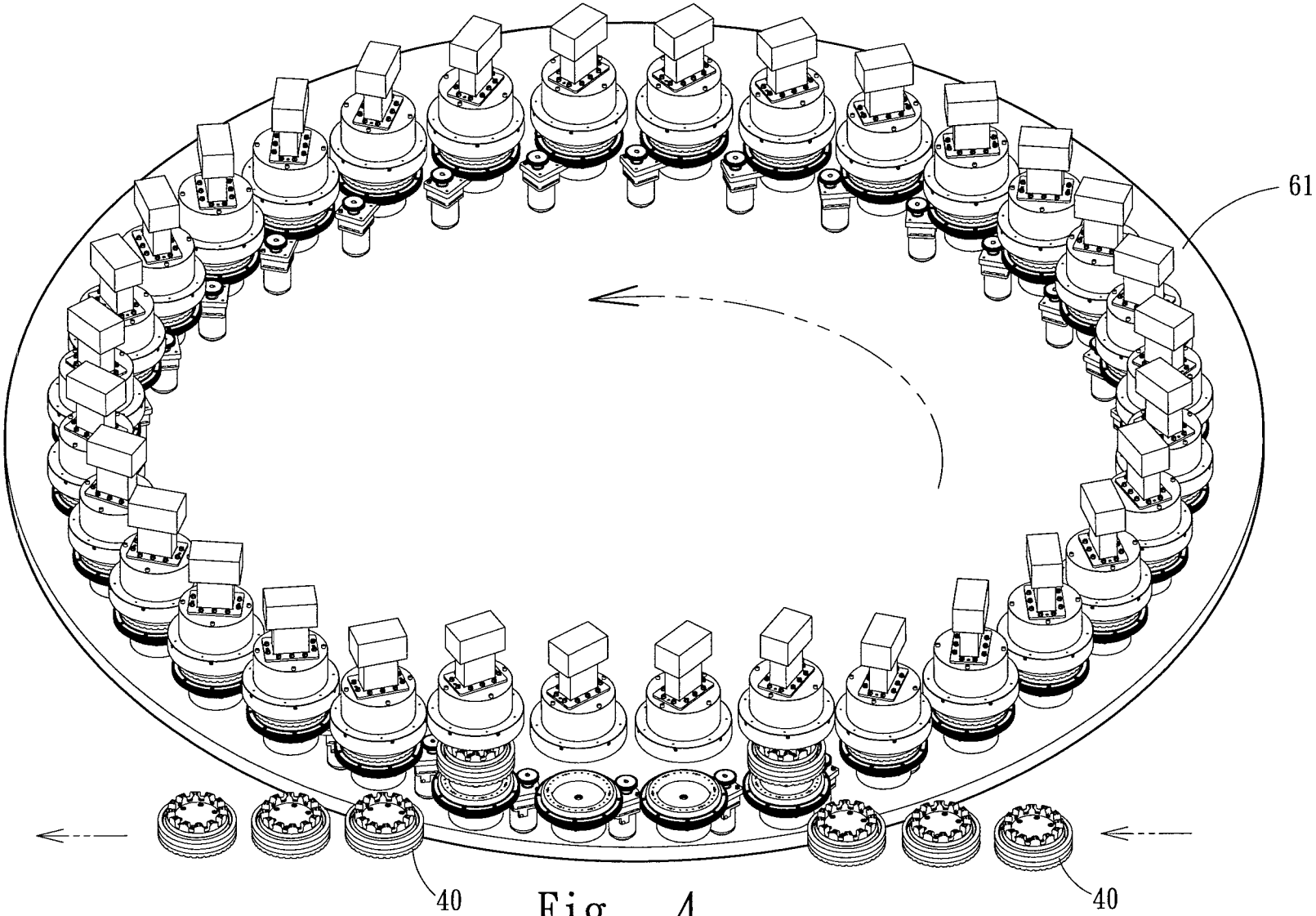
FIG. 4 is an illustrative diagram of a preferred embodiment of the composite heating modules to achieve continuous heating.

A practical system application of the present invention is illustrated in FIG. 4. Turning back to FIG. 3, the microwave heating unit 70, the microwave heating semi-cavity 30, the conductive heating unit 20, the conductive heating power controller 80, the spinning plate 50 and the motor 51 are grouped in view to constitute the composite heating module 60. As illustrated in FIG. 4, one preferred embodiment includes several composite heating modules 60 in annular arrangement on a rotating device 61. The rotating device 61 can be a rotating circular disk or a conveyor belt arranged in a circle. The heat-receiving object is placed in the sealed container 10, and the sealed container 10 is further placed and locked inside the conductive heating semi-cavity 40. In FIG. 4, the loaded conductive heating semi-cavity 40 is fed into at one side of the rotating device 61 and then assembled with the microwave heating semi-cavity 30, forming the composite heating module 60 with a microwave resonant cavity. As the composite heating module 60 is rotating and moving forward annularly with the rotating device 61, the microwave heating unit 70 and the conductive heating unit 20 of the composite heating module 60 heat up the object inside each of the conductive heating semi-cavity 40. In one preferred embodiment, the conductive heating unit 20 is equipped with the conductive heating power controller 80 in order to adjust the heating power. As the heating is completed, the conductive heating semi-cavity 40 is separated from the microwave heating semi-cavity 30 at another side of the rotating device 61. Since the conductive heating semi-cavity 40 have already left microwave influence, the measurements of the heated object are conducted without the influences of the microwave interference or effect. The accuracy of the measurements (such as temperature or color) can be accordingly achieved. The conductive heating semi-cavity 40 carrying the sealed container 10 can be transferred to additional heating, holding or cooling processes. As a result, the present invention can be adjusted to fit in any production line, such as foodstuff cooking, sterilization or bactericidal processing, to meet specific needs of different heating processes.

As stated in the above descriptions, compared to the conventional techniques, the present invention has the following advantages:

1. Higher heating temperature: Since the sealed container is pressed and locked inside the conductive heating semi-cavity by the mechanical strength, it can resist a higher expansion pressure, which means that the heat-receiving object can be heated to a higher temperature.

2. High-efficiency conduction heating: In conventional heating systems, the conductive heating is inefficient without the use of high-pressure hot water, hot steam, or other fluids as additional heating sources. In contrast, at the initial stage of heating, the present invention allows microwaves to directly heat the heat-receiving object in the sealed container. As the sealed container begin to expand due to the heat, it will press tightly against the conductive heating semi-cavity inner wall. As a result, the conductive heating unit can efficiently heat up the object through the conductive heating semi-cavity body through conduction heating.

3. Normal-pressure cavity configuration and low operation cost: Different from the conventional pressurized cavities with air, with hot water or hot steam providing the overriding pressure needed to counter-act the expansion of the sealed container, which also act as additional heating mediums, the present invention is operated at a higher heating temperature but requires only atmospheric environment. Thus the problem of heat loss is solved. It is evident that the system building and operation cost of the present invention can be greatly saved.

4. Modular cavity designs, creating a flexible production line: In view of the conventional fixed-cavity microwave heating system, the scale of production often depends on the cavity volume. Once the scale of capacity needs to be changed, the microwave resonant distribution and parameters must be correspondingly re-tested; and the heating cavities re-designed. On the contrary, the present invention is modular with the composite heating modules, which means each module is independent and has no influence on each other. Consequently, the number of the composite heating modules can be randomly added onto or taken off the production line to meet the needs of industrial production without affecting the microwave heating semi-cavity designs of the system.

5. Suitable for a continuous production without batch operations: Loaded onto the rotating device in the production line, the composite heating modules with the sealed containers continuously move in and out one by one during the process. Thus, the present invention can function continuously without batch operations.

6. Measuring parameters of the heat-receiving object in a non-microwave environment during processing: The majority of the electronic measuring equipment are easily burned, destroyed or disabled due to microwave influence. For this reason, it is difficult to apply the usual equipment to measure the quality of the heat-receiving object in the microwave heating semi-cavities. In contrast, the present invention feed the conductive heating semi-cavity 40 with the sealed containers into and out of the production line for several times, so the heating process can be arranged in multiple sections. Between two heating sections, since the conductive heating semi-cavity 40 is away from the microwave resonant cavity, the measurements can be performed to ensure the quality of the object. The operator can also adjust the heating power in the subsequent heating sections accordingly, simply with the use of the usual equipment. As a result, the final processing quality of the object can be guaranteed.

7. The flexibility to combine microwave heating and conductive heating into a hybrid heating process: Conventional microwave heating methods easily result in partial temperature differences; or the so-called cold and hot spots; while conventional conductive heating methods do not have problems with temperature non-uniformity, but has the shortcomings of poor heating efficiency and longer heating-time. The present invention has the flexibility to appropriately deploy the use of the microwave heating and conductive heating according to the characteristics of the heat-receiving object.

8. Enhancing temperature uniformity with rotating devices cavities: The present invention offers devices in which the heat-receiving objects are placed, (such as spinning plates) that spin or rotate inside the microwave resonant cavity, reducing temperature differences in the circumferential direction caused by microwave heating.

What is claimed is:

1. A hybrid modular microwave heating system with separable cavities used to heat a heat-receiving object, comprising:

a conductive heating semi-cavity comprising a conductive heating semi-cavity body and a conductive heating semi-cavity lid, wherein said conductive heating semi-cavity body includes a conductive heating semi-cavity inner wall, a conductive heating semi-cavity outer wall and a receiving space defined by said conductive heating semi-cavity inner wall for accommodating a sealed container with said heat-receiving object, and wherein said conductive heating semi-cavity lid is made of a microwave-transparent material and seals said receiving space via pressing against said sealed container;

a microwave heating semi-cavity separably disposed on said conductive heating semi-cavity and comprising a microwave heating semi-cavity body, a microwave heating semi-cavity sleeve and a wave guiding channel, wherein said microwave heating semi-cavity sleeve is annularly located at one side of said microwave heating semi-cavity body which is closed to said conductive heating semi-cavity, and said wave guiding channel is disposed on another side of said microwave heating semi-cavity body, and when said microwave heating semi-cavity sleeve presses down against said conductive heating semi-cavity outer wall, said microwave heating semi-cavity is combined with said conductive heating semi-cavity to form a microwave resonant cavity which is defined by the interior of said microwave heating semi-cavity body and said receiving space inside said conductive heating semi-cavity;

a rotatable conductive heating unit, located under said conductive heating semi-cavity and directly contacting with said conductive heating semi-cavity, wherein said rotatable conductive heating unit provides heat to said conductive heating semi-cavity to heat said heat-receiving object; and a microwave heating unit, disposed on said wave guiding channel for generating microwaves, wherein said microwaves are propagated via said wave guiding channel into said microwave resonant cavity to effect on said heat-receiving object.

2. The system as recited in claim 1, wherein said microwave heating semi-cavity body is made of ferromagnetic materials.

3. The system as recited in claim 1, wherein said rotatable conductive heating unit can be an electromagnetic heater, a gas heater, a sheathed heater, or a combination thereof.

4. The system as recited in claim 1 further comprising a spinning plate for carrying said microwave resonant cavity to rotate.

5. The system as recited in claim 4 further comprising a motor, wherein said spinning plate is equipped with a driven gear, and said motor is equipped with a gear to engage with said driven gear to transmit the power of the motor to rotate said spinning plate.

6. The system as recited in claim 5, wherein said rotatable conductive heating unit is equipped with and power-controlled by a conductive heating power controller;

said microwave heating unit, said microwave heating semi-cavity, said rotatable conductive heating unit, said conductive heating power controller, said spinning plate and said motor are modularized as a composite heating module; and the system comprises a multiple of said composite heating modules and said conductive heating semi-cavities so that said composite heating modules are arranged annularly on a rotating device and said conductive heating semi-cavities are fed into and out of the corresponding composite heating modules thereof one by one.

* * * * *